US005488902A

United States Patent [19]

Dorenkamp

[11] Patent Number: 5,488,902

[45] Date of Patent: Feb. 6, 1996

[54] DEVICE FOR MOUNTING AND ADJUSTING A METERING ROLLER IN A FINISHING UNIT

[75] Inventor: Felix Dorenkamp, Hemsbach, Germany

[73] Assignee: Heidelberger Druckmaschinen AG, Heidelberg, Germany

[21] Appl. No.: 272,244

[22] Filed: Jul. 8, 1994

[30] Foreign Application Priority Data

Jul. 8, 1993 [DE] Germany ..... 43 22 791.0

[51] Int. Cl.[6] ..... B41F 5/04; B41F 31/34

[52] U.S. Cl. ..... 101/216; 101/352

[58] Field of Search ..... 101/349, 350, 101/351, 352, 207, 208, 209, 210, 148, 247, 216

[56] References Cited

U.S. PATENT DOCUMENTS

| | | | |
|---|---|---|---|
| 1,811,784 | 6/1931 | Fischer | 101/352 |
| 3,538,849 | 11/1970 | Bohman | 101/352 |
| 4,569,306 | 2/1986 | Ito et al. . | |

FOREIGN PATENT DOCUMENTS

| | | |
|---|---|---|
| 3427898 | 11/1985 | Germany . |
| 3906648 | 10/1989 | Germany . |
| 9206416 | 8/1992 | Germany . |

*Primary Examiner*—J. Reed Fisher

*Attorney, Agent, or Firm*—Herbert L. Lerner; Laurence A. Greenberg

[57] ABSTRACT

A combination of a finishing unit for a rotary printing press disposed up-line from a delivery, including a form cylinder, a metering roller, and at least one applicator roller, with sheet-guiding cylinders cooperatively engaging with the finishing unit, the finishing unit having side walls of multipartite construction and being formed with swivel joints, includes an adjusting eccentric for swivelling the metering roller into various positions relative to the applicator roller wherein a transfer and an interruption of transfer, respectively, of finishing fluid onto the surface of the metering roller in accordance with defined fluid-conveying principles occurs, and locking elements insertable in components of the side walls for predetermining a mutual spacing of axes of the metering roller and the applicator roller.

10 Claims, 4 Drawing Sheets

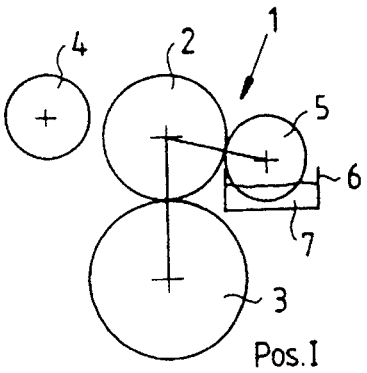
Fig.1
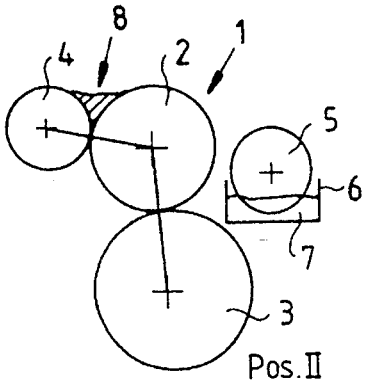
Fig.2
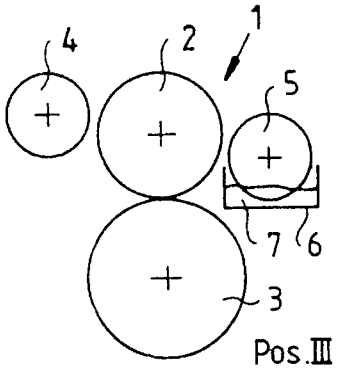
Fig.3
Fig.4
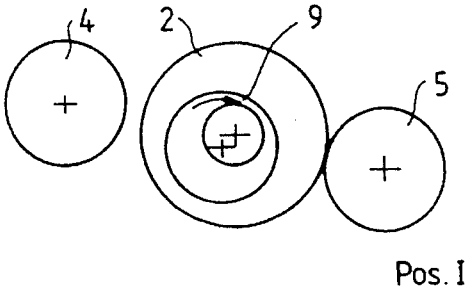
Fig.5
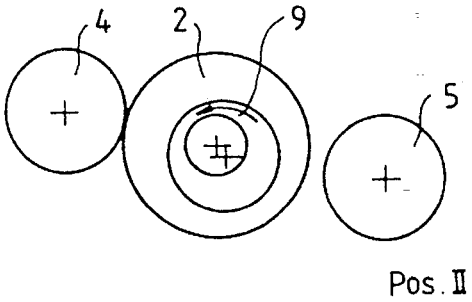

1
4
2
27
28
33
34
29
32
30
31
3
26

DEVICE FOR MOUNTING AND ADJUSTING A METERING ROLLER IN A FINISHING UNIT

The invention relates to a finishing unit for a rotary printing press disposed up-line from a delivery, such a finishing unit including a form cylinder, a metering roller, and at least one applicator roller, and cooperating with sheet-guiding cylinders, side walls of the finishing unit being of multipartite construction and including swivel joints or hinges.

German Published Patent Document DE 39 06 648 A1 discloses such an application or job unit for a printing press. The application or job unit is suitable for offset printing, gravure printing as well as for flexographic printing. Depending upon the respective printing method applied, it is necessary to transpose the doctor blade which wipes the surface of a dip roller and a jacket of a form cylinder, respectively, as well as to transpose the liquid-containing reservoir. However, this heretofore disclosed device does not permit a change from one fluid-conveying method to another fluid-conveying method while performing a given printing process.

German Published Patent Document DE 34 27 898 C1 shows a device applying fluids, in particular a varnish coating unit for a printing press. Due to a partition or baffle plate formed with several communication channels and being immersed in a roller nip containing an ink supply, damping of vibrations of the ink supply and uniform distribution of the fluid supply is achieved. It is not possible to change over to a different fluid-conveying method, however, with the device according to the German Published Patent Document DE 34 27 898 C2.

German Utility Model G 92 06 416.7 U1 discloses a varnish coating unit for a printing press having side walls of multipartite construction. An impression cylinder is received in a stationarily provided lower part, and a form cylinder, as well as an applicator roller and a metering roller, is mounted on an upper part swivellable relative to the lower part. Due to the fact that the upper component can be swivelled with respect to the lower component, the entire varnish coating unit can be disengaged from the impression cylinder. With this prior-art solution, it is not possible to change over to another method of supplying finishing fluid.

Proceeding from this state of the art, it is an object of the invention to optimize a finishing unit so as to ensure trouble-free processing over a wide range of finishing fluids, with the metering roller being freely adjustable.

With the foregoing and other objects in view, there is provided, in accordance with the invention, in combination, a finishing unit for a rotary printing press disposed up-line from a delivery, and including a form cylinder, a metering roller, and at least one applicator roller, and sheet-guiding cylinders cooperatively engaging with the finishing unit, the finishing unit having side walls of multipartite construction and being formed with swivel joints, comprising an adjusting eccentric for swivelling the metering roller into various positions relative to the at least one applicator roller wherein a transfer and an interruption of transfer, respectively, of finishing fluid onto the surface of the metering roller in accordance with defined fluid-conveying principles occurs, and locking means insertable in components of the side walls for predetermining a mutual spacing of axes of the metering roller and the at least one applicator roller.

This construction has the advantage, amongst others, that with two applicator rollers, both applicator rollers remain permanently in the finishing unit, whereas the metering roller may be selectively engaged at one of the two applicator rollers. While one applicator roller is supplied from below with fluid from a pan, the other applicator roller is supplied with a varnish coating from above the nip formed between the applicator roller and the form cylinder. The free adjustability of the metering roller is maintained because, by locking the side-wall components, the metering roller maintains a constant distance from the fluid-supplied applicator roller. The side-wall components receiving the respective applicator roller, not in use at this time, are not locked, thus resulting in a variable spacing between the axis of the applicator roller not in use and the metering roller. This permits the metering roller to follow printing pressure adjustments, without subjecting the roller nip formed between the metering roller and the applicator roller in use to any changes.

In further embodiments of the inventive concept, the sidewall components are formed as bearing brackets and index plates and can be moved about centers of rotation. The locking means joining a respective bearing bracket and a respective index plate are formed as index bolts or clamping screws. When index bolts are used, the bearing brackets or index plates are formed with index bores and are bolted together by the index bolts. When clamping screws are used as the locking means, the bearing brackets and the index plates are formed with oblong holes or slots so that different fixed distances between the the rollers mounted on the bearing brackets and the index plates can be set.

The finishing unit offers a further possibility of adjustment in that the two applicator rollers are received in fine adjustment eccentrics of the bearing brackets. Thus, fine adjustments can be effected after engagement by the metering roller with one applicator roller or the other.

Furthermore, both index plates movable about swivel joints or hinges are mounted on journals of the metering roller, thus facilitating the generation of a fixed spacing between the metering roller and the respective applicator roller in use, and permitting a variable spacing between the applicator not in use and the metering roller which may thus readily follow operationally determined adjustments without hindrance.

Finally the invention provides that the main drive of the rotary printing machine drives the metering roller via a sheet-guiding cylinder and the form cylinder. Alternatively, the metering roller may be driven by two pinions which are driven by a transmission gearwheel which, in turn, is driven by a drive gear connected to a separate drive.

Other features which are considered as characteristic for the invention are set forth in the appended claims.

Although the invention is illustrated and described herein as embodied in a device for mounting and adjusting a metering roller in a finishing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1, 2 and 3 are diagrammatic views of various positions into which a metering roller is shiftable with respect to applicator rollers;

FIG. 4 is an enlarged fragmentary view of FIG. 1 showing the position I of the metering roller;

FIG. 5 is an enlarged fragmentary view of FIG. 2 showing the position II of the metering roller;

Figure 6:
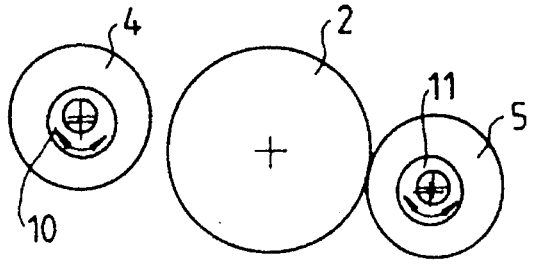
FIG. 6 is a view like that of FIG. 4 showing fine-adjustment eccentrics provided on the applicator rollers.

Referring now to the drawings and, first, particularly to FIGS. 1, 2 and 3 thereof, there are shown therein diagrammatically various positions of operation into which a metering roller 2 is swivellable with respect to applicator rollers 4 and 5 in a finishing unit 1.

In the finishing unit 1 according to FIG. 1, the metering roller 2 assumes a position I in which it is engaged with the surface of a pan or dip roller 5 which, in turn, conveys a fluid 7 from a fluid-containing pan 6 and applies the fluid onto the surface of the metering roller 2 from which the fluid is transferred to the surface of a form, e.g., a varnish blanket or oil cloth or the like, mounted on a form cylinder 3.

In FIG. 2, the metering roller 2 of the finishing unit 1 is engaged with the applicator roller 4. In a position II shown therein, fluid is transferred from a roller wedge 8 formed between the surfaces of the applicator roller 4 and the metering roller 2, via the metering roller 2, onto the form mounted on the circumference of the form cylinder 3.

In FIG. 3, the metering roller 2 assumes a position III in those cases wherein no fluid is to be applied to the surface of the form cylinder 3. It is apparent from this figure that the metering roller 2 is engaged with neither of the applicator rollers 4 and 5 and, in fact, there are respective gaps between the applicator rollers 4 and 5 and the metering roller 2.

FIGS. 4 and 5, respectively, illustrate the positions I and II into which the metering roller 2 is swivellable by an adjusting eccentric 9. Journal pins provided at respective end faces of the metering roller 2 are received in eccentric bushings of the adjusting eccentrics 9 which, in turn, may be actuatable by remote control, e.g., by rods or linkages via pneumatic cylinders. The view of FIG. 6 shows fine-adjustment eccentrics 10 and 11, respectively, assigned to the two applicator rollers 4 and 5. By means of the eccentrics 10 and 11, the spaced distance between the applicator rollers 4 and 5, respectively, and the metering roller 2 are finely adjustable. This is advantageous, because the two applicator rollers 4 and 5 are stationarily mounted on the side walls of the finishing unit 1, and the metering roller 2 executes the swivelling motion. For these reasons, a precise fine adjustment of the mutual spacing between the roller jackets can be achieved more readily by appropriately supporting or journalling the applicator rollers 4 and 5.

Figure 7:
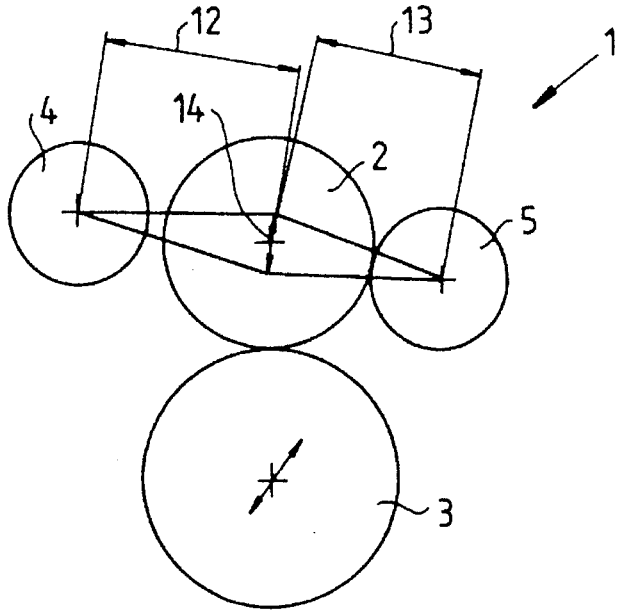
FIG. 7 is an enlarged view of FIG. 1 showing the adjusting range of the metering roller.

FIG. 7 diagrammatically illustrates the metering roller 2 which assumes the position I in which it is engaged with the applicator roller 5. A distance 13 between the centers of the applicator roller 5 and the metering roller 2 is constant, whereas a distance 12 between the centers of the metering roller 2 and the applicator roller 4 is variable. Assurance is thereby offered that the motility or displaceability of the metering roller 2 within an adjusting range indicated by a double-headed arrow 14 is maintained. The adjustments to be effected within the indicated adjusting range relate, e.g., to impression throw-on/throw-off and printing pressure adjustments with respect to the form cylinder 3. When these adjustments are being performed, the spacing between the roller surfaces of the metering roller 2 and the applicator roller 5 remains constant, while the variable distance 12 permits the adjustments to be executed all the more.

Figure 8:
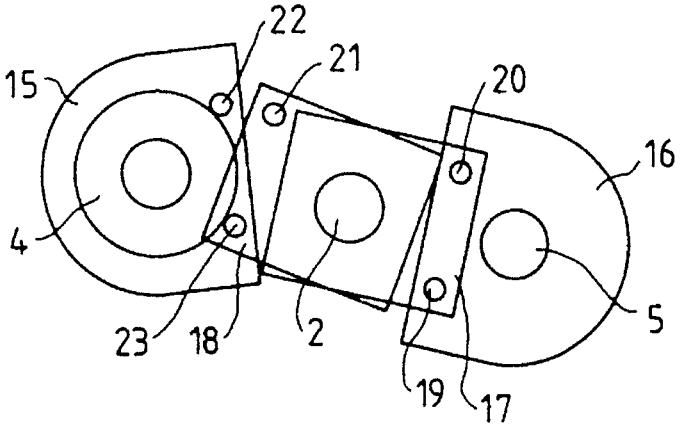
FIGS. 8 and 9 are diagrammatic views of different locking means and the function thereof with respect to determining the spacing between the metering roller and the applicator rollers.
Figure 9:
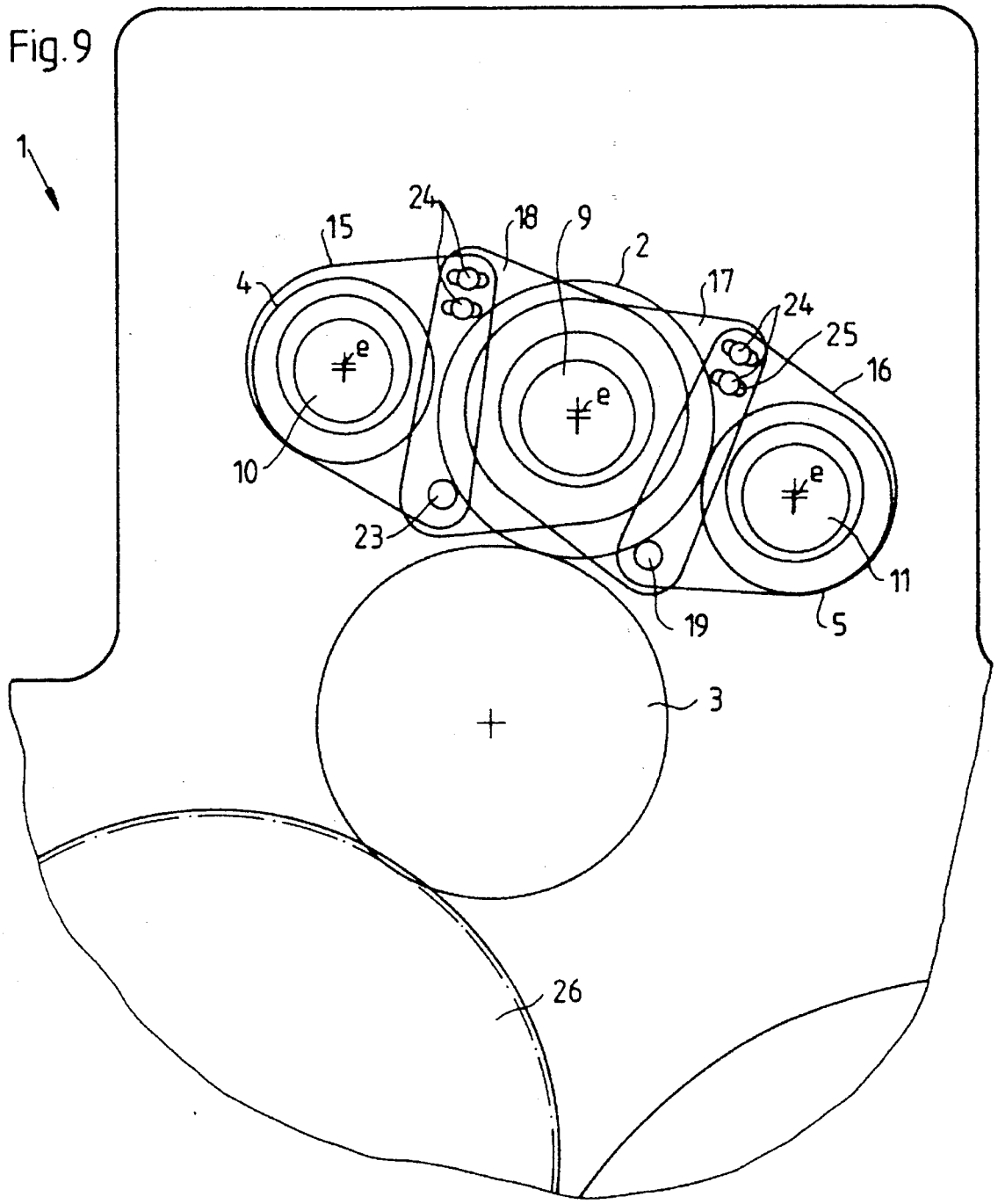

FIGS. 8 and 9 illustrate various locking means and the function thereof with respect to determining the spacing between the respective roller centers.

FIG. 8 shows a bearing bracket or bearing plate construction or assembly having index bolts 20 which serve as locking means. A journal of the applicator roller 4 is received in a bearing bracket 15 of the construction or assembly which has an index bore 22 formed therein. An index plate 18 is swivellable about a swivel point or center of rotation 23 of the bearing bracket 15 and, in turn, supports a journal of the metering roller 2, and is formed with another index bore 21. The bearing bracket or plate 15 and the index plate 18 are articulatedly connected to one another at the center of rotation 23. A journal of the applicator roller 5 is received in a bearing bracket 16 of the construction or assembly whereon, also, an index plate 17 is articulatedly connected at a swivel point or center of rotation 19. The journal of the metering roller 2 also passes through the index plate 17; in the configuration shown in FIG. 8, the index plate 17 is attached to the bearing bracket 16, however, by an index bolt 20 penetrating the mutually aligned index bores 21 and 22 of the index plate 17 and of the bearing bracket 16. Consequently, the index plate 17 is rigidly disposed with respect to the bearing bracket 16 and ensures a constant spacing 13 between the centers of the metering roller 2 and the applicator roller 5. Accordingly, when adjustments of the metering roller 2 are being performed, relative displacements may be compensated for by a compensating movement of the index plate 18 about the swivel point or center of rotation 19. Within the adjusting range 14, the adjustments may be effected, e.g., along a circular path corresponding to the length of the double-headed arrow; and are accordingly dissociable or resolvable into vertical and horizontal components (see FIG. 7). Because the vertical and horizontal components are constantly changing during the traversal of an adjusting path, the compensation may be effected in a relatively simple manner by relative motion of the index plate 17 and the bearing bracket 15 about the center of rotation 19.

FIG. 9 shows a configuration wherein clamping screws are used as locking means.

The metering roller 2 and the applicator rollers 4 and 5 are received in eccentrics 9, 10 and 11 of bearing brackets 15 and 16 and index plates 17 and 18 of trapezoidal surface area. Analogous to the configuration represented in FIG. 8, the bearing bracket 15 of FIG. 9 is rotatably connected to the index plate 18 at the swivel point or center of rotation 23, whereas the bearing bracket 19 and the index plate 17 are articulatedly connected to one another at the pivot point or center of rotation 19. Compared with the configuration shown in FIG. 8, the index plates 17 and 18 and the bearing brackets 15 and 16 of FIG. 9 are formed with oblong holes or slots 25 instead of circular index bores 21 and 22. The slots 25 are provided with clamping screws 24 by means of which the spacing or distance between the respectively used applicator roller 4 and 5 and the metering roller 2 can be determined, whereas the spacing or distance between the respectively not-used applicator roller 4 and 5 and the metering roller 2 can be kept variable.

Figure 10:
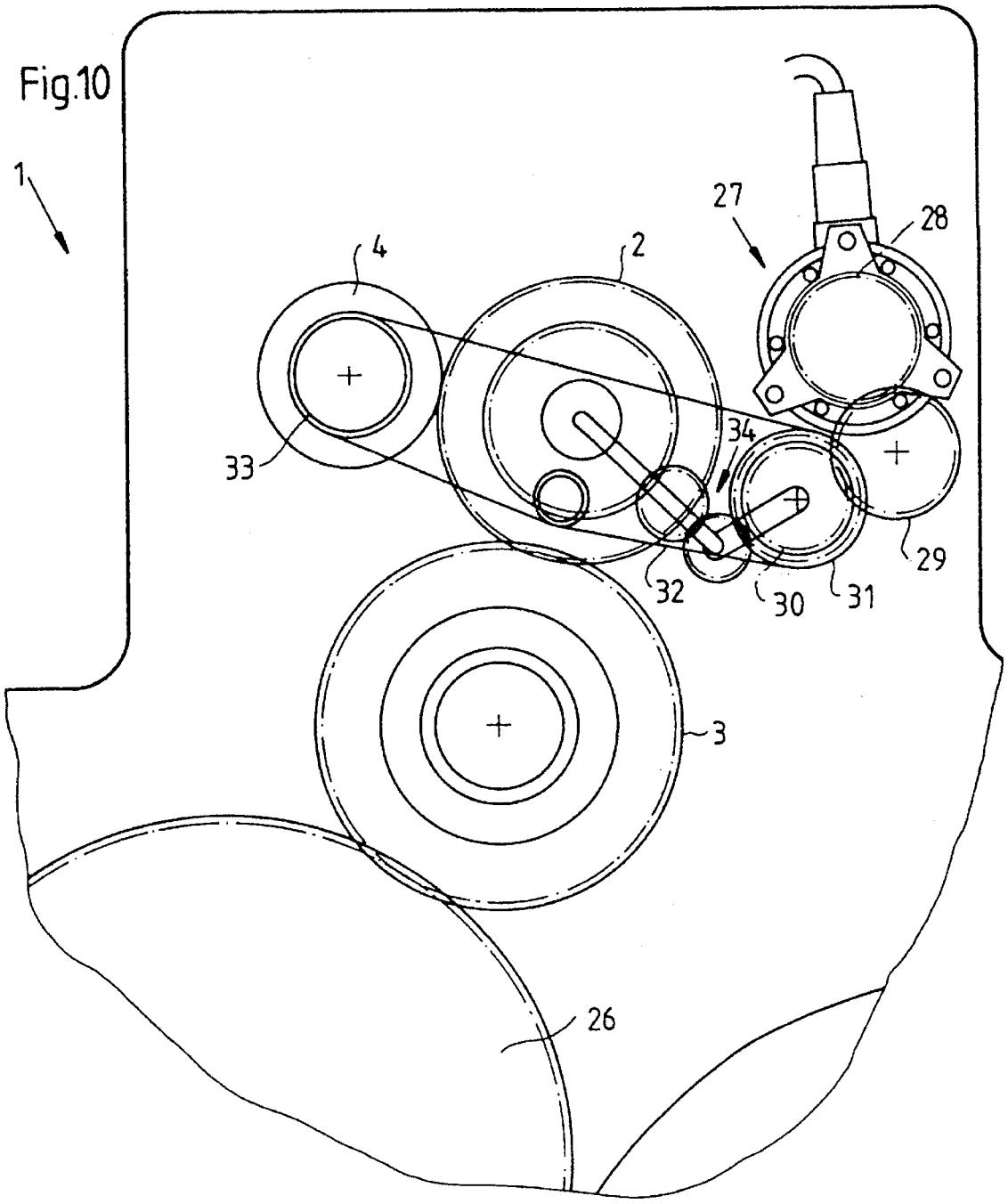
FIG. 10 is a diagrammatic view of the drive of the metering roller and conveyor rollers.

FIG. 10 shows the drive of the applicator rollers 4 and 5.

A drive 27 which drives an intermediate gear 29 via a drive gear 28 is fastened to the side part or frame of the finishing unit 1. The intermediate gear 29 communicates the drive to a transfer gear 30 which is mounted on a journal of the applicator roller 5. Via a belt 32, a belt pulley 31, also mounted on the journal of the applicator roller 5, drives the applicator roller 4 on which there is provided a belt pulley 33. Via two pinions 34, a metering-roller gear 35 and thus the metering roller 2 are driven by the drive 27, it being also conceivable to drive the metering roller 2 by means of a sheet-guiding cylinder 26 and the form cylinder 3. When no sheets are conveyed, the metering roller 2 is moved by the drive 27 in order to ensure that the fluid to be applied is continually circulated.

What is claimed is:

1. In combination, a finishing unit for a rotary printing press disposed up-line from a delivery, and including a form cylinder, a metering roller, and at least one applicator roller, and sheet-guiding cylinders cooperatively engaging with the finishing unit, the finishing unit having side walls of multipartite construction and being formed with swivel joints, comprising an adjusting eccentric for swivelling the metering roller into various positions relative to the at least one applicator roller wherein a transfer and an interruption of transfer, respectively, of finishing fluid onto the surface of the metering roller in accordance with defined fluid-conveying principles occurs, and locking means insertable in components of the side walls for predetermining a mutual spacing of axes of the metering roller and the at least one applicator roller.

2. Finishing unit according to claim 1, wherein the components of the multipartite side walls are formed as bearing brackets and index plates movable about the swivel joints.

3. Finishing unit according to claim 1, wherein said locking means are formed as index bolts.

4. Finishing unit according to claim 1, wherein said locking means are formed as clamping screws.

5. Finishing unit according to claim 2, wherein said bearing brackets and said index plates are formed with index bores.

6. Finishing unit according to claim 2, wherein said bearing brackets and said index plates are formed with slots, and said locking means are formed as clamping screws receivable in said slots.

7. Finishing unit according to claim 2, including a fine-adjustment eccentric disposed in at least one of said bearing brackets for adjusting said at least one applicator roller.

8. Finishing unit for a rotary printing machine according to claim 2, wherein the components of the multipartite side walls include two index plates movable about the swivel joints, the metering roller having a journal whereon said index plates are mounted.

9. Finishing unit according to claim 1, including means for driving the metering roller, said driving means comprising a gear train connecting one of the sheet-guiding cylinders and the form cylinder to the metering roller.

10. Finishing unit according to claim 1, including means for driving the metering roller, comprising a drive device and a gear transmission including an intermediate gearwheel, a transmission gearwheel and two pinions connected to another, said drive device being connected by said gear transmission to the metering roller.

* * * * *